United States Patent [19]

Hambleton et al.

[11] Patent Number: 5,010,660

[45] Date of Patent: Apr. 30, 1991

[54] METHOD AND APPARATUS FOR DRYING GLASSWARE

[75] Inventors: Larry G. Hambleton, Olathe, Kans.; Claude L. Sears, Liberty; Elmer B. Offutt, Independence, both of Mo.

[73] Assignee: Labconco Corporation, Kansas City, Mo.

[21] Appl. No.: 293,956

[22] Filed: Jan. 6, 1989

Related U.S. Application Data

[62] Division of Ser. No. 92,898, Sep. 4, 1987, Pat. No. 4,820,351.

[51] Int. Cl.[5] ..... F26B 13/30

[52] U.S. Cl. ..... 34/92; 34/104

[58] Field of Search ..... 34/104, 92, 68, 107

[56] References Cited

U.S. PATENT DOCUMENTS

| | | | |
|---|---|---|---|
| 2,480,227 | 8/1949 | Derr | 34/104 X |
| 2,786,480 | 3/1957 | Hofer | 134/171 |
| 3,070,104 | 12/1962 | Faust et al. | 134/165 X |
| 3,463,173 | 8/1969 | Goldman | 134/165 X |
| 3,590,863 | 7/1971 | Faust | 134/165 X |
| 3,836,329 | 9/1974 | Jordan | 134/2211 X |
| 4,310,010 | 1/1982 | Svoboda | 134/201 X |
| 4,346,057 | 8/1982 | Bowser | 34/92 X |
| 4,354,514 | 10/1982 | Sundheimer et al. | 134/170 X |
| 4,827,629 | 5/1989 | Ball et al. | 34/104 |

FOREIGN PATENT DOCUMENTS

| | | | |
|---|---|---|---|
| 566265 | 9/1975 | Switzerland | 134/170 |
| 1008741 | 11/1965 | United Kingdom | 134/170 |

*Primary Examiner*—Henry A. Bennet

*Attorney, Agent, or Firm*—Kokjer, Kircher, Bradley, Wharton, Bowman & Johnson

[57] ABSTRACT

Apparatus for washing and vacuum drying long necked laboratory flasks is presented. The apparatus includes a cabinet which presents a washing and drying compartment and a pump and rotary spray arm. A special rack which can be rolled into and out of the compartment includes a central manifold and a plurality of distribution arms extending radially from the manifold. Upright spindle tubes extend from the distribution arms to receive the inverted flasks such at that the tubes extend through the narrow necks of the flasks with the open ends of the tubes located within the bodies of the flasks. A diaphragm coupling allows water to be pumped to the manifold for delivery to the spindle tubes during washing and rinsing cycles. The tubes spray the water directly inside of the flask bodies for thorough washing and rinsing. A vacuum conduit extending from the manifold carries a seat which engages a gasket to couple the manifold with a vacuum blower when the rack is moved into the cabinet. During the drying cycle, the blower applies vacuum through the manifold to the spindle tubes to draw moist air out of the flasks and replace it with drier air from the compartment. The vacuum drying system recirculates and heats the air and mixes it with dry outside air for enhanced drying of the flasks.

9 Claims, 5 Drawing Sheets

6.
6.

METHOD AND APPARATUS FOR DRYING GLASSWARE

This is a division of application Ser. No. 092,898, filed Sept. 4, 1987, now U.S. Pat. No. 4,820,351.

BACKGROUND OF THE INVENTION

This invention relates generally to the cleaning of laboratory glassware and more particularly to apparatus for drying laboratory volumetric flasks and other long necked glassware articles.

Beakers, flasks, test tubes and other glassware which is commonly used in laboratories must be thoroughly cleaned after use in order to remove deposits which could contaminate materials subsequently contained in the glassware. Often, glassware is cleaned manually with a brush. This manual procedure is generally unsatisfactory because it requires considerable time on the part of highly paid laboratory assistants or other personnel whose time can be spent more productively on other tasks. Also, the detergent is very difficult to rinse from the glassware, usually requiring an acid rinse.

The automatic glassware washing machines that have been available in the past operate much like ordinary household dishwashing machines. The glassware is inverted and loaded on one or more racks which can be moved into and out of the cabinet of the machine. One or more spray arms located beneath the rack or racks apply upwardly directed wash and rinse sprays which wash and then rinse the glassware. Heated air for drying of the glassware is circulated within the cabinet during the drying cycle.

Although this type of machine effectively cleans and dries beakers and other glassware articles having a wide mouth, volumetric flasks and other narrow necked glassware articles are not thoroughly washed by conventional spray arms. The long, narrow neck of the flask prevents the wash and rinse sprays from fully entering the flask and effectively cleaning and rinsing its inside surface. In order to enter the flask at all, the spray must originate directly beneath the open end of the flask. Even then, the long neck usually intercepts the spray before it reaches the body of the flask. Consequently, the inside of the flask is not adequately washed, particularly the bottom surface which is most in need of washing because it is most likely to contain wax, grease, chemicals and other residues.

Thorough drying of long necked flasks is even more difficult. Circulating hot air within the washer compartment is not effective because the circulating air cannot enter and flow through the narrow neck of the flask in sufficient quantities to adequately dry the inside of the flask. Hot air drying dries the outside flask surface and raises its temperature above that of the inside surface which is less exposed to the circulating air. The air within the flask remains moist, and water particles condense on the cooler inside surface of the flask when it is removed from the machine, even though the flask appears to be dry. Condensation creates water spots and build up of water within the flask. Consequently, even if the flasks are thoroughly washed and rinsed, the machines that have been used in the past are not able to effectively dry flasks and other narrow necked articles of glassware.

SUMMARY OF THE INVENTION

The present invention is directed to a method and apparatus for washing and drying narrow necked glassware in a more thorough and effective manner than has been achieved in the past. In accordance with the invention, the flasks are received on a rack which can be rolled into and out of a washing and drying compartment within the cabinet of the machine. The rack has a central manifold and a plurality of distribution arms which extend radially from the manifold and which each carry a plurality of vertical spindle tubes open at their top ends. The flasks are inverted and placed on the tubes such that the tubes extend through the necks and into the flask bodies where they can spray pressurized washing and rinsing water directly against the inside surfaces of the flask and especially the bottom surfaces which contain most of the residues.

It is a particularly important feature of the invention that drying of the inside surfaces of the flasks is achieved by applying vacuum to the tubes in order to draw the moisture laden air out of the flasks. Air from within the compartment then naturally replaces the moist air that is removed through the tubes, and the drier air which is thus circulated within the flasks effectively dries their inside surfaces. At the same time, the inside and outside temperatures of the flasks are equalized to inhibit subsequent condensation.

It is an important object of the invention to utilize the same tubes and distribution system for applying the washing and rinsing water and also applying vacuum during the drying cycle. This simplifies the structure of the machine and minimizes the number of parts.

In conjunction with the immediately preceding object, it is another object of the invention to provide a means for effectively isolating the vacuum system from the washing and rinsing system. A single ball valve acts to close off the manifold from the vacuum system during the washing and rinsing cycles and to close off the water entry port when vacuum is applied during the drying cycle. As a result, when the vacuum system is active to dry the glassware, water is not drawn into the vacuum conduits in any appreciable quantity.

Another and related feature of the invention is the provision of a hinged trap door which disposes of any liquid that does manage to leak past the ball valve and into the vacuum system. Any liquid that leaks into the vacuum conduits is directed into a duct where it opens the normally closed trap door and drains off without damaging or otherwise interfering with the components of the vacuum system.

A further object of the invention is to provide a flask washer of the character described wherein the conduits through which liquid and vacuum are applied to the manifold uncouple from the manifold so that the rack can be rolled out of the washer compartment for loading and unloading of glassware.

Still another object of the invention is to provide a flask washer in which dry outside air is mixed with the air that is drawn out of the washer compartment and the resulting air mixture is heated and circulated in the compartment for drying of the glassware therein.

An additional object of the invention is to provide a flask washer of the character described which is constructed in a simple and economical manner and which is arranged to maximize the glassware capacity.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
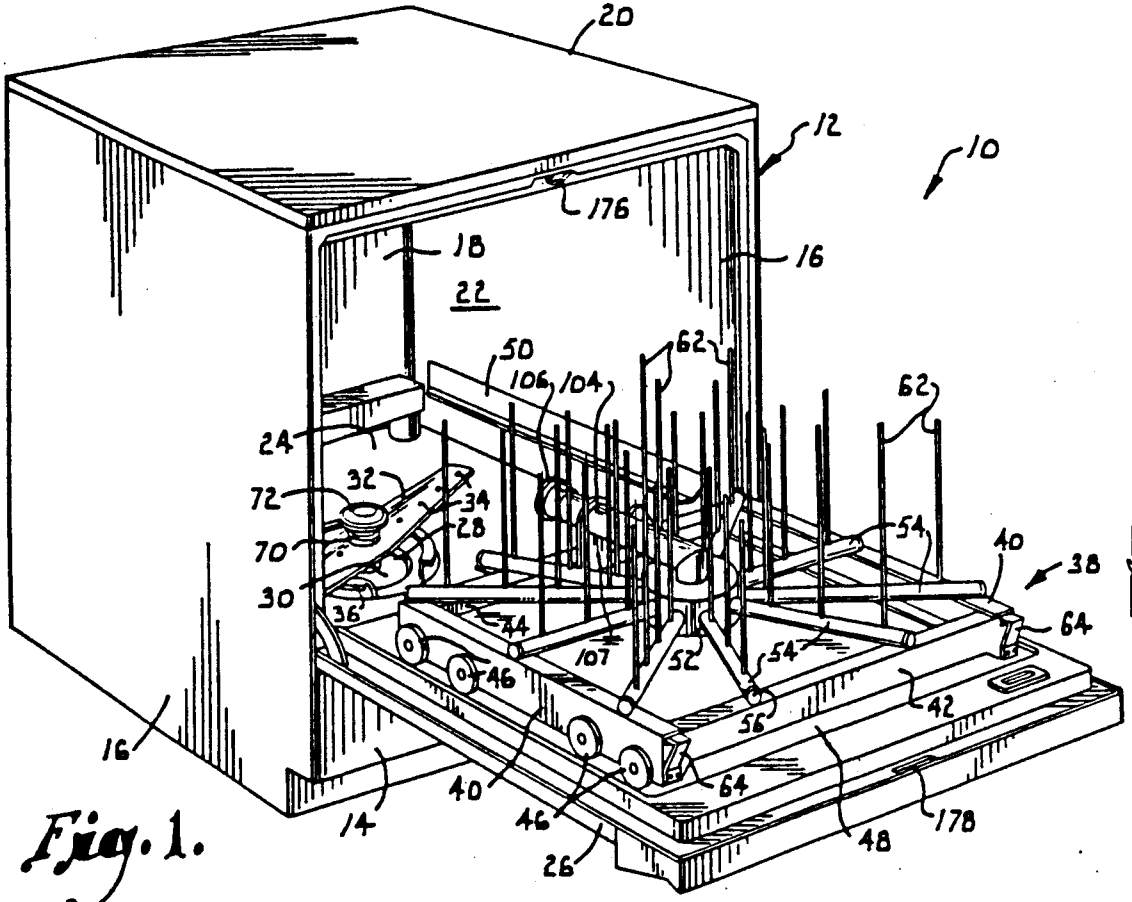
FIG. 1 is a perspective view from the front of a flask washing machine constructed according to a preferred embodiment of the present invention, with the door in its open position and the glassware rack moved out of the cabinet.

Referring now to the drawings in more detail and initially to FIG. 1 in particular, numeral 10 generally designates a flask washing machine constructed in accordance with a preferred embodiment of the present invention. A box-like cabinet 12 of the machine includes a base 14 which rests on the floor or supporting surface, a pair of opposite side panels 16, a back panel 18 and a top panel 20. A washing and drying compartment 22 is formed within the cabinet 12. The floor of the compartment 22 is formed by a bottom panel 24 which is located immediately above the base 14. A hinged door 26 on the front of the cabinet can be opened and closed about a horizontal hinge axis. When the door is open as shown in FIG. 1, it has a horizontal orientation and the compartment 22 is then accessible from the front. When the door 26 is closed, it has a vertical orientation and encloses compartment 22 and its contents. The door 26 has a suitable latch (not shown) which latches it in the closed position.

A pump 28 is mounted in a well or sump 30 formed in the center of the bottom panel 24. Pump 28 is driven by an electrical motor and operates to pump washing and rinsing liquid into a rotary spray arm 32. The spray arm 32 rotates when water is applied to it under pressure by the pump 28, and a spray of water is discharged from the spray arm 32 through a series of spray openings 34 spaced along the spray arm. An electrical heating element 36 is provided in the area of the sump 30 in order to heat the water during the washing and rinsing cycles and also to heat the air within compartment 22 during the drying cycle of the machine.

The glassware which is to be cleaned is loaded onto a rack which is generally designated by numeral 38. The rack 38 has a rectangular frame formed by parallel opposite sides 40 and front and back members 42 and 44, all of which may be channel members. Each of the sides 40 is provided with two pairs of rotatable wheels 46 which permit the rack 38 to be rolled into and out of the compartment 22. When the door 26 is open, the rack 38 may be rolled out of compartment 22 onto the door. The inside surface of door 26 is recessed as indicated at 48, and the wheels 46 engage the opposite sides of the recess 48 in order to guide rack 38 as it is rolled onto the door and off of the door back into the compartment. The opposite side walls 16 of cabinet 12 are provided on their inside surfaces with tracks 50 which are located above the bottom panel 24 and which receive the wheels 46 when rack 38 is rolled into compartment 22.

Figures 5, 7, 8:
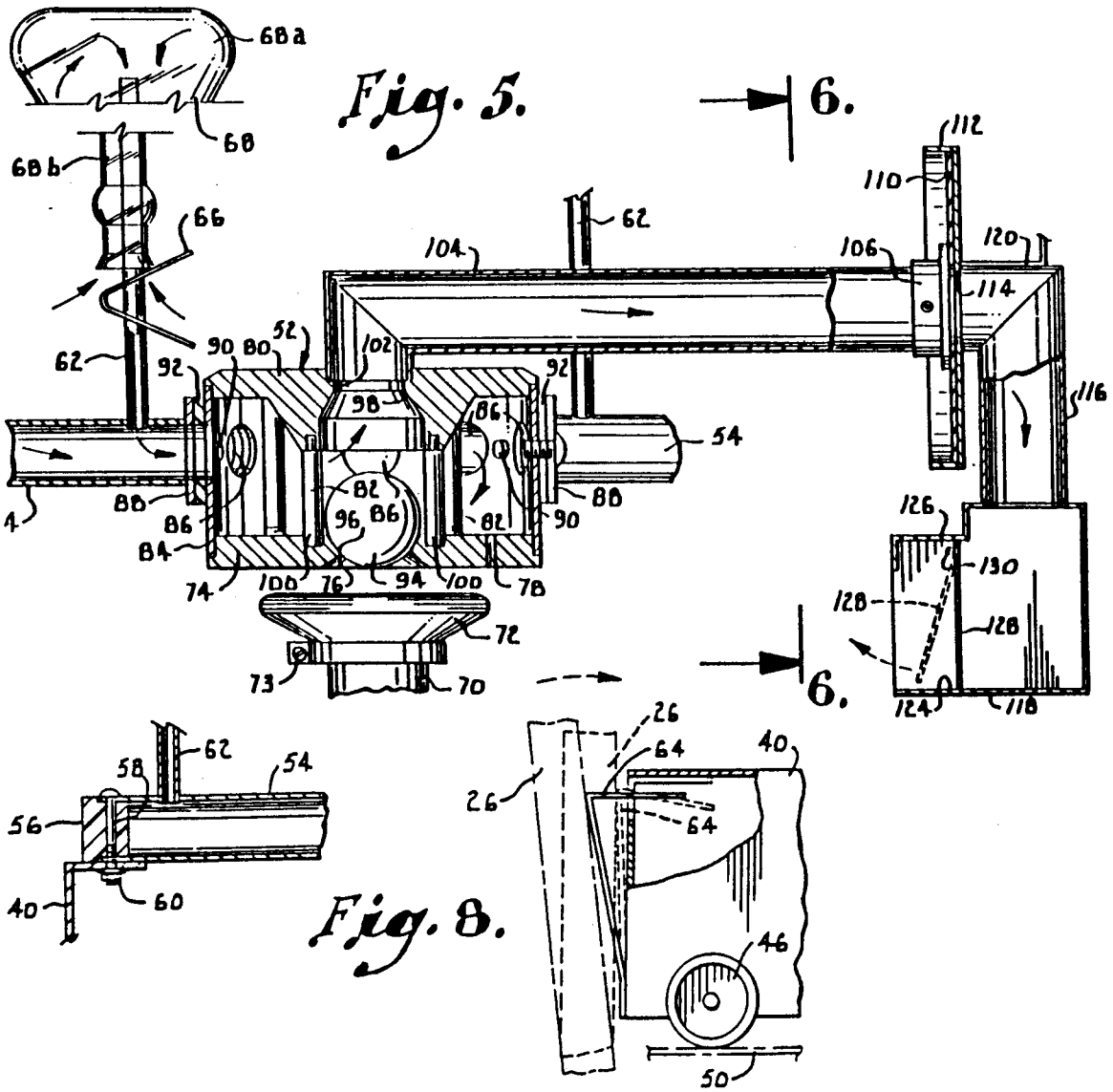
FIG. 5 is a fragmentary sectional view similar to FIG. 4 but showing the positions of the components during a drying cycle of the machine, with the directional arrows indicating the airflow pattern during the drying cycle.
FIG. 7 is a fragmentary sectional view on an enlarged scale taken generally along line 7—7 of FIG. 3 in the direction of the arrows.
FIG. 8 is a fragmentary elevational view taken generally along line 8—8 of FIG. 3 in the direction of the arrows, with a portion broken away for purposes of illustration and the broken lines showing the positions of the components when the cabinet door is fully closed.

Mounted at the center of rack 38 is a generally cylindrical manifold 52. Extending radially from the manifold 52 are a plurality of horizontal distribution arms 54 each formed by a hollow conduit. Each arm 54 communicates at its inner end with the interior of manifold 52 and is closed at its outer end by a plug 56. The outer end of each arm 54 rests on and is secured to the frame of rack 38. As best shown in FIG. 7, a bolt 58 extends through each plug 56 and the outer end of the corresponding distribution arm 54. The bolt also extends through the upper flange of the underlying frame member 40 and is secured by a nut 60. This mounts the arms 54 and manifold 52 on the rack 38.

Figure 3:
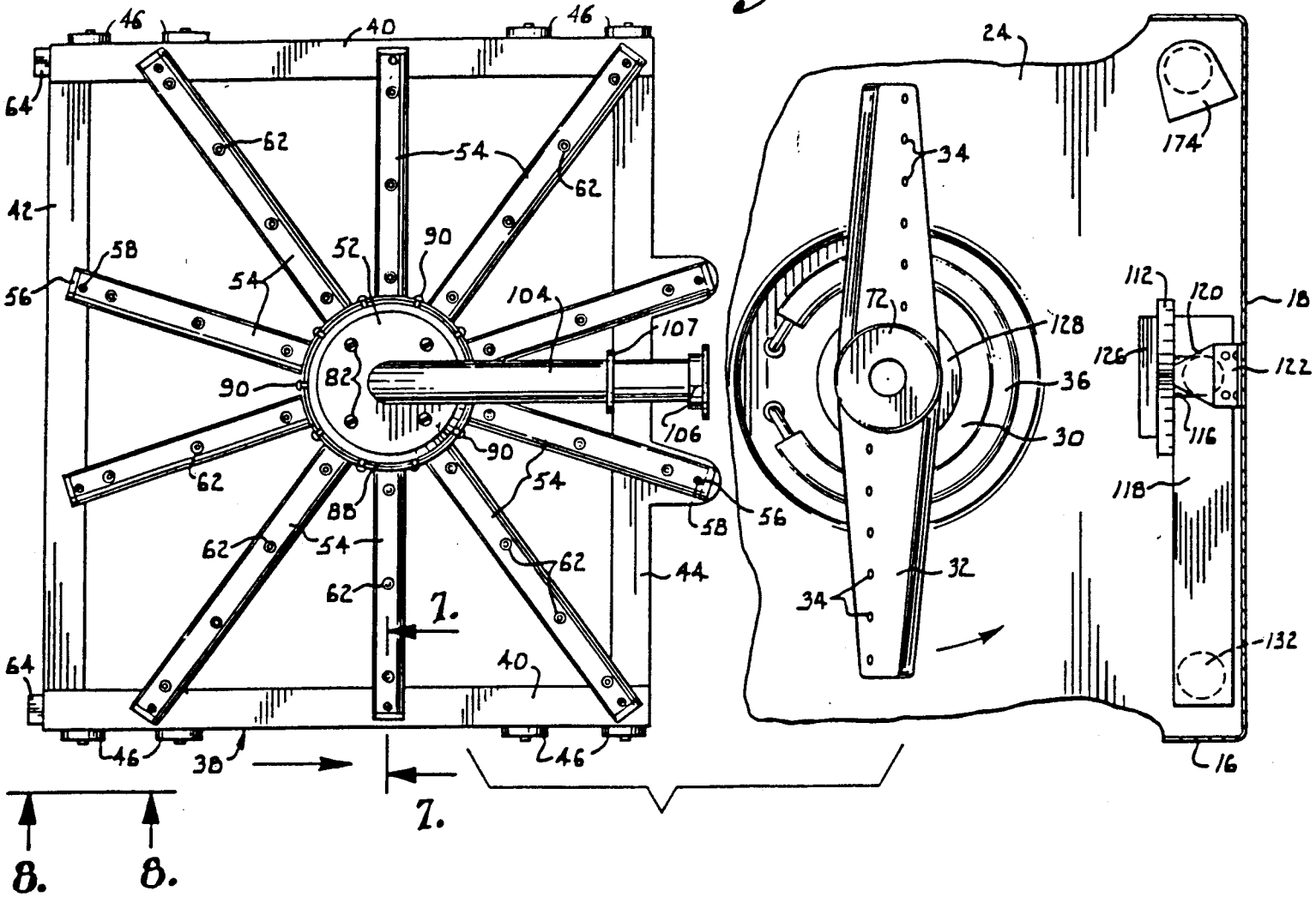
FIG. 3 is an exploded top plan view showing the cabinet interior and the glassware rack, with the bottom panel of the cabinet shown only fragmentarily.

Each distribution arm 54 carries a plurality of upstanding spindle tubes 62 which are spaced uniformly along the length of the arm. Each tube 62 has an open top end and a lower end which communicates with the hollow interior of the corresponding distribution arm 54 (see FIG. 7). As best shown in FIG. 3, the distribution arms 54 may have different lengths and may carry different numbers of tubes 62. The arms which extend generally toward the corners of the rack 38 are longer than the other arms and may be provided with four spindle tubes 62. The remaining arms 54 are each provided with three spindle tubes 62. Preferably, there are four long arms and six short arms so that there are a total of 34 spindle tubes 62.

A pair of flat springs 64 are mounted on the frame of rack 38 at the opposite ends of the front frame member 42. As best shown in FIG. 8, each flat spring 64 normally projects forwardly from member 42. When rack 38 is fully inserted into compartment 22 and door 26 is then closed, the inside surface of the door engages flat spring 64 and displaces them to the position shown in broken lines in FIG. 8. Then, the flat springs 64 are retracted substantially flush with the front surface of rack 38. The flat springs 64 resist being displaced by spring action and thereby urge rack 38 rearwardly in cabinet 12 by spring action.

Figure 2:
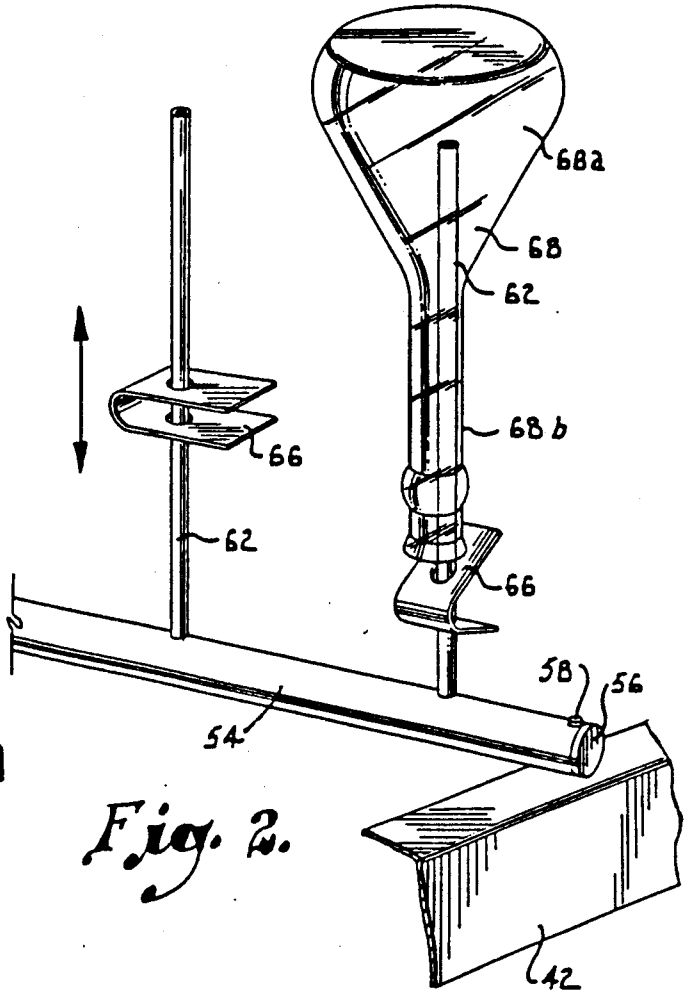
FIG. 2 is a fragmentary perspective view on an enlarged scale of the outer end portion of one of the distribution arms of the glassware rack, with a long necked flask applied to one of the upright spindle tubes.
Figure 4:
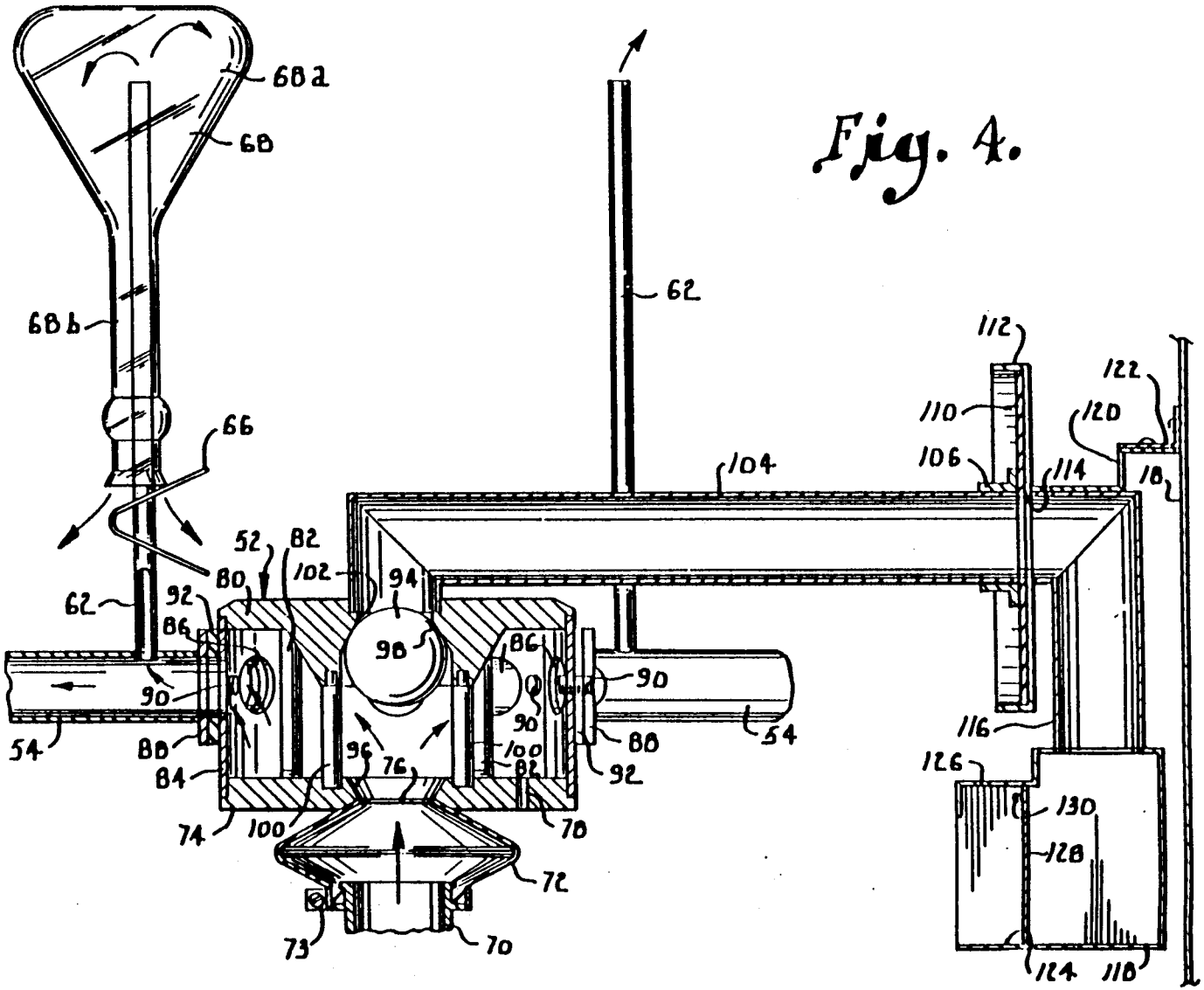
FIG. 4 is a fragmentary sectional view on an enlarged scale taken on a vertical plane through the glassware and showing the positions of the components of the machine during a washing cycle, with the directional arrows indicating the flow of water during the washing cycle.

Each tube 62 receives a metal spring clip 66 which serves to support a long necked glassware article such as the long necked flask 68 shown in FIGS. 2 and 4–5. The flask 68 includes a bulbous body 68*a* and a long, narrow neck 68*b* which terminates at an open end at the top of the flask. Each spring clip 66 is formed by a pair of tabs which are joined at a curved bight portion of the clip. The tabs are urged away from one another by spring action, and each spring clip 66 is thereby held in place on tube 62. Each spring clip can be adjusted up or down on tube 62 by pressing the tabs toward one another and then moving the spring clip to the desired position before releasing the tabs. When flask 68 is inverted and placed on one of the tubes 62, its end engages spring clip 66 in order to hold the flask in place with tube 62 extending through the neck 68*b* and the open end of the tube located within the body 68*a*. Preferably, the open end of the tube is close to but spaced from the bottom surface of the flask so that water which is pumped through the tube under pressure will spray against the entirety of the bottom surface of the flask.

Referring now particularly to FIGS. 4 and 5, a short water conduit 70 extends upwardly from the center of spray arm 32 to receive a portion of the water which is pumped into the spray arm during the washing and rinsing cycles of pump 28. A diaphragm type coupling 72 is mounted on the top end of conduit 70. Coupling 72 is secured to conduit 70 by a clamp 73. The coupling 72 may be the same type disclosed in Jarvis et al. U.S. Pat. No. 3,951,683 which is incorporated herein by reference. Coupling 72 is located immediately below manifold 52 when rack 38 is fully inserted into compartment 22. In the absence of fluid pressure applied to conduit 70 by pump 28, coupling 72 is in a relaxed condition and is uncoupled from manifold 52, as shown in FIG. 5. However, when pump 28 is active to pump fluid under pressure into conduit 70, the diaphragm type coupling 72 expands and is coupled to manifold 52, as shown in FIG. 4.

With continued reference to FIGS. 4 and 5 in particular, the manifold 52 has a bottom disk 74 provided with a central flared port 76 which is connected with the interior of coupling 72 in the expanded condition of the latter. A drain passage 78 is formed through disk 74 at a location offset from its center. The top of manifold 52 is formed by a disk shaped member 80 which is connected with disk 74 by a plurality of bolts 82 or other fasteners. A curved band forms the side wall 84 of the manifold 52. The side wall 84 is provided with a plurality of circular openings 86 which register with the distribution arms 54. The inner end of each arm 54 carries a flange 88 which is secured to the manifold side 84 by a pair of screws 90. Preferably, a gasket 92 is sandwiched between each flange 88 and side wall 84 to provide a fluid tight seal between the manifold and the distribution arms. The screws 90 can be easily removed to detach each individual arm 54 from the manifold so that the arm and its spindle tubes 62 can be cleaned or serviced.

A valve ball 94 is disposed within manifold 52. When pump 28 is inactive so that water is not being applied to manifold 52, the ball 94 falls under the influence of gravity onto a flared lower seat 96 formed on disk 74. When seated on the lower seat 96, port 76 is blocked as shown in FIG. 5. When water under pressure is applied to manifold 52, the water pressure unseats ball 94 from seat 96 and forces it upwardly against a second flared seat 98 formed on member 80. A plurality of guide pins 100 extend between members 74 and 80 to guide and restrict movement of ball 94 between the upper and lower seats 98 and 96. When ball 94 is seated on the upper seat 98, it blocks an opening 102 formed in the top member 80 of the manifold.

An L-shaped vacuum conduit 104 connects with opening 102 and forms part of the vacuum system used in the drying of glassware. As best shown in FIG. 4, the main portion of conduit 104 extends horizontally and carries on its back end a vacuum tube seat 106. A bracket 107 (see FIG. 1) receives conduit 104 and is secured at its lower end to frame member 44 of the rack. When rack 38 is fully inserted into compartment 22, vacuum tube seat 106 contacts and mates with an annular gasket 110 mounted on a vacuum fitting 112. The vacuum fitting is formed by a flanged plate having a center opening 114. When rack 38 is fully received in compartment 22, the vacuum conduit 104 communicates through gasket 110 with opening 114, and the gasket 110 provides an effective seal between the seat 106 and fitting 112. An L-shaped conduit 116 is rigidly connected at its top end with fitting 112 and at its bottom end with the top of a generally rectangular duct 118. A bent bracket plate 120 is secured to conduit 118 and to an angle bracket 122. The angle bracket 122 is in turn riveted or otherwise secured to the back panel 18 of the cabinet.

Figure 6:
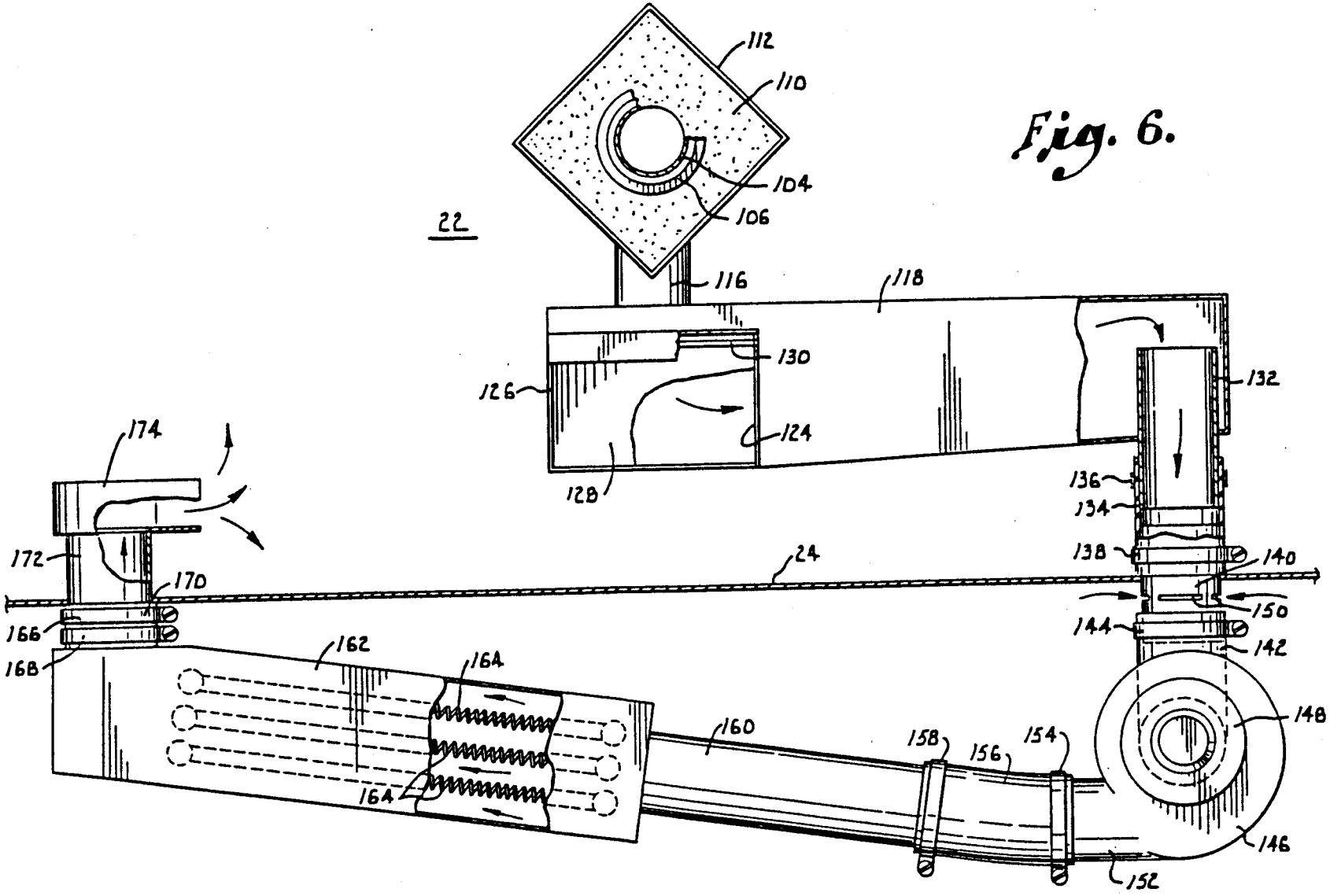
FIG. 6 is a fragmentary sectional view taken generally along line 6—6 of FIG. 5 in the direction of the arrows, with portions broken away for purposes of illustration and the directional arrows indicating the airflow pattern during the drying cycle.

Referring additionally to FIG. 6, duct 118 is provided with a frontal opening 124 at a location below the connection between conduit 116 and duct 118. The floor of duct 118 slopes, and opening 124 is at its low end. A box 126 which is open at the front extends forwardly from duct 118 around the opening 124. The opening 124 is normally closed by a trap door 128 which is mounted to pivot in hinged fashion about a horizontal hinge pin 130 which extends between the sides of box 126. Door 128 can pivot about pin 130 to the open position shown in broken lines in FIG. 5 in order to drain any water that collects in duct 118. Preferably, the floor of box 126 is sloped forwardly so that water will drain out of the duct and box.

With continued reference to FIG. 6 in particular, a short vertical conduit 132 extends into duct 118 on the end opposite its connection with conduit 116. A flexible coupling 134 is clamped onto the lower end of conduit 132 by a hose type clamp 136. Another clamp 138 connects coupling 134 with the top end of a rigid conduit 140 which extends downwardly through the bottom panel 24. The lower end of conduit 140 is connected with a flexible coupling 142 by another clamp 144. Coupling 142 is a curved coupling which connects with the intake of a wet/dry vacuum blower 146. The blower 146 is located in the base of cabinet 12 and is driven by an electric motor 148. Below panel 24, conduit 140 has a plurality of exposed slots 150 through which air is drawn into the intake side of blower 146 from outside of compartment 22.

The discharge side of blower 146 is provided with a discharge conduit 152 which is connected by clamp 154 with a flexible coupling 156. Another clamp 158 connects coupling 156 with a conduit 160 which extends to connection with a rectangular heater housing 162 containing a plurality of electrical resistance heating elements 164. The opposite or outlet end of housing 162 is connected with a coupling 166 by a clamp 168. Another clamp 170 connects coupling 172 with a short vertical conduit which extends upwardly through bottom 24 and into compartment 22. A hood 174 is carried on the top end of conduit 172 to direct air generally along the back panel 18 of the cabinet, as best shown in FIG. 3.

In operation of the flask washing machine, door 26 is opened and rack 38 is rolled onto the door out of compartment 22 so that flasks can be loaded in inverted positions onto the spindle tubes 62. The open end of each flask engages clip 66 in order to maintain the flask in place with the open top end of tube 62 located within the flask body 68*a* a short distance away from the bottom of the flask. When all of the flasks have been loaded onto rack 38, the rack is rolled into compartment 22, and door 26 is raised to the closed position and latched prior to initiating the washing cycle of the machine.

During the washing cycle, water enters compartment 22 from an adjacent water line (not shown). A detergent cup and dispenser (not shown) may be provided on the inside surface of door 26 in order to add suitable detergent to the water for washing of the flasks. The heating element 36 is energized to heat the water and generate steam which assists in cleaning of the glassware.

Pump 28 is activated during the wash cycle to pump the water from sump 30 into the spray arm 32 and conduit 70. The water which is pumped into spray arm 32 under pressure causes the arm to rotate and to discharge through the spray openings 34 in order to spray the water against the outside surfaces of the glassware.

The pressure of the water which is pumped into coupling 72 expands the coupling against the bottom of manifold 52 in the position shown in FIG. 4. The water pressure unseats ball 94 from seat 96 and holds the ball against the upper seat 98. The water which enters manifold 52 flows out of the manifold in substantially equal amounts through the radial distribution arms 54. The water in each distribution arm flows upwardly through the spindle tubes 62 and is discharged from the spindle tubes through their open top ends, as indicated by the directional arms in FIG. 4. The water spray which is emitted from each tube 62 is directed against the inside surface of the flask 68 and particularly the bottom surface which is most likely to contain deposits. The water flows down the inside surface of the neck 68*b* in order to wash it before flowing out the open end of the flask and draining back into the sump 30.

At the end of the wash cycle, the wash water is drained from the cabinet and a rinse cycle is initiated. During the rinse cycle, rinse water is pumped into the spray arm 32 and manifold 52 in the same manner as the wash water. The rinse water may be distilled water or another type of purified water which is effective in thoroughly rinsing the glassware. The rinse water is sprayed against the outside surfaces of the flasks by the spray arm 32 and is supplied from manifold 52 through arms 54 and tubes 62 to rinse the insides of the flasks. During the wash and rinse cycles, the pressure of the water which is pumped into manifold 52 maintains ball 94 firmly seated against the upper seat 98 in order to prevent water from leaking into the vacuum conduit 104 or any other part of the vacuum system.

At the end of the rinse cycle, the rinse water is drained from the cabinet and a drying cycle is initiated. During the drying cycle, motor 148 is energized to power the vacuum blower 146, and heating elements 164 are energized along with the heating element 36 located within compartment 22. Pump 28 is now inactive and coupling 72 naturally uncouples from manifold 52 due to the absence of water pressure in conduit 70. Ball 94 then falls under the influence of gravity against seat 96, and any water that remains in manifold 52 drains out through the drain passage 78. Blower 146 creates a vacuum on its intake side which draws air from within flasks 68 into the open top ends of tubes 62, as shown by the directional arrows in FIG. 5. The air is drawn through tubes 62 and into the distribution arms 54 and then into manifold 52. The air flows from manifold 52 through conduit 104, seat 106, conduit 116, duct 118 and out of the duct into the intake side of blower 146. As the air approaches the intake side of the blower, it is mixed with outside fresh air which is drawn into slots 150. The resulting air mixture is forced by blower 146 through the heater housing 162 where it is heated by the heating elements 164 prior to being discharged into compartment 22 through conduit 172 and hood 174.

The air which is forced by the blower into compartment 22 is circulated therein past the flasks 68 in order to dry their outside surfaces. The air is heated by heating elements 164 prior to entering compartment 22 and is further heated in the compartment by heating element 36. In addition to drying the outside surfaces of the flasks, the air which is circulated within compartment 22 is drawn upwardly into the flasks 68 in order to replace the moisture laden air which is drawn out of the flasks into tubes 62 by the vacuum drying system. The air which is thus drawn into the open end of each flask is circulated within the flask prior to being drawn into tube 62 and passed through the vacuum system as previously described.

In this manner, the moist air within the interior of each flask is drawn by the vacuum system out of the flask and is replaced by hotter and drier air which is pulled into the flask from compartment 22. The air which is removed from the flask is mixed with outside air and is heated both by the heating elements 164 and by heating element 36. Preferably, the added fresh air which enters the vacuum system through slots 150 amounts to approximately 30% of the total air quantity which is passed through the vacuum system. In order to accommodate this added air, mating vents 176 and 178 (see FIG. 1) are provided in the cabinet 12 and in door 26 to vent air from within compartment 22. The mixing of fresh, dry air with the air which is recirculated enhances the ability of the machine to effectively dry the glassware and causes relatively moist air to be vented through the vents 176 and 178.

At the end of the drying cycle, door 26 can be opened and rack 38 can be rolled out of the cabinet onto the door so that the clean and dry glassware can be removed from the rack. Because air from within compartment 22 is circulated within the interiors of the flasks during the drying cycle, the outside and inside surfaces of the flasks are at substantially the same temperature at the end of the drying cycle. Consequently, water does not tend to condense on the inside surfaces of the flasks when they are removed from the rack.

The airflow pattern which is effected within the flasks by the vacuum drying system is particularly effective in drying the entirety of the inside surface of each flask. It should be understood that although heating of the air during the drying cycle is preferred, the glassware can be dried effectively without heating due to the good airflow pattern that is achieved by the vacuum system.

The ball valve 94 isolates the vacuum system from the liquid which is applied during the washing and rinsing cycles, and it closes port 76 during the drying cycle. The ball 94 must be heavy enough to remain firmly in place on the lower seat 96 when vacuum is being applied during the drying cycle. Otherwise, the ball could shuttle up and down during the drying cycle and cause loss of vacuum. Conversely, the ball 94 must be light enough to remain against the upper seat 98 during the washing and rinsing cycle. If the ball is so heavy that the water pressure is unable to maintain it against seat 98, the ball can oscillate up and down during the washing and rinsing cycles and possibly allow water to enter the vacuum system. It has been found that the ball can be conveniently constructed of nylon having a specific gravity of approximately 1.14.

The hinged door 128 readily disposes of any water that does leak past ball 94 and into the vacuum duct 118. During the wash cycle, any water buildup in the vacuum duct 118 will open door 128 and flow out of duct 118 beneath the lower edge of door 128, and then drain back into the cabinet prior to the drying cycle. During the drying cycle, the hinged door 128 is held in the fully closed position by the vacuum which is applied to duct 118. In normal operation, door 128 is cycled between the open and closed positions when the vacuum is applied and removed. This cycling action maintains door 128 in good working order and keeps it from sticking.

The flexible diaphragm type coupling 72 and gasket 110 allow the glassware rack 38 to couple with and uncouple from the pumping and vacuum systems so that the rack can be moved into and out of compartment 22. The flat springs 64 on the front end of rack 38 act to urge the rack rearwardly within compartment 22 in order to maintain a good seal between vacuum tube seat 106 and gasket 110. Vacuum tube seat 106 is adjustable front to back to insure alignment of diaphragm type coupling 72 and manifold 52.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. Apparatus for drying glassware articles each having an open top end, said apparatus comprising:

a housing presenting a substantially enclosed compartment;

a manifold coupled with said housing;

a plurality of generally horizontal conduits coupled with and extending radially outward from said manifold;

a plurality of generally vertical tubes coupled with each of said conduits, each of said tubes being adapted to receive a glassware article thereon in an inverted position with the open end of the tube located within the article; and means for applying vacuum to said manifold to draw air from within said articles while air from the compartment enters said articles through the open top ends thereof to effect circulation of air within the articles to dry the insides of the articles.

2. Apparatus as set forth in claim 1, including means for circulating in said compartment the air that is drawn into the tubes, whereby to dry the outsides of the articles.

3. Apparatus as set forth in claim 2, including means for heating the air that is circulated in said compartment.

4. Apparatus as set forth in claim 1, including:

a rack carrying said manifold and conduits thereon, said rack being movable into and out of said compartment;

a vacuum fitting on said housing to which said vacuum is applied by said vacuum applying means;

a vacuum conduit coupled to said manifold for applying vacuum thereto; and a vacuum coupling on said vacuum conduit arranged to automatically couple with said vacuum fitting in a manner to transmit vacuum therebetween when said rack is moved into said compartment, said vacuum coupling being separable from said vacuum fitting to permit said rack to be moved out of the compartment.

5. Apparatus as set forth in claim 1, wherein said vacuum applying means comprises a blower having an intake side communicating with said manifold to apply vacuum thereto and a discharge side communicating with said compartment to circulate air therein.

6. Apparatus as set forth in claim 5, including means for heating the air between said discharge side of the blower and said compartment.

7. Apparatus as set forth in claim 6, including means in said compartment for heating the air that is circulate therein.

8. Apparatus as set forth in claim 5, including means for providing communication between said intake side of the blower and the exterior of said compartment, whereby to mix outside air with the air which is drawn through said tubes, conducts and manifold and to then circulate the mixed air in said compartment.

9. Apparatus as set forth in claim 8, including means for heating the mixed air before entry thereof into said compartment.

* * * * *